US008746678B2

(12) United States Patent
Uchino

(10) Patent No.: US 8,746,678 B2
(45) Date of Patent: Jun. 10, 2014

(54) IMAGE FORMING DEVICE CAPABLE OF STABLY FEEDING RECORDING SHEET

(71) Applicant: Yuta Uchino, Nagoya (JP)

(72) Inventor: Yuta Uchino, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 13/628,270

(22) Filed: Sep. 27, 2012

(65) Prior Publication Data

US 2013/0140761 A1 Jun. 6, 2013

(30) Foreign Application Priority Data

Dec. 2, 2011 (JP) ..... 2011-265003

(51) Int. Cl.
*B65H 3/06* (2006.01)

(52) U.S. Cl.
USPC ..... 271/117; 271/10.13

(58) Field of Classification Search
USPC ..... 271/117, 118, 114, 109, 164
See application file for complete search history.

(56) References Cited

U.S. PATENT DOCUMENTS 6,874,776 B2 * 4/2005 Gaarder et al. ..... 271/10.04
7,413,183 B2 * 8/2008 Asada et al. ..... 271/117
7,673,870 B2 * 3/2010 Koga et al. ..... 271/10.11
7,681,876 B2 * 3/2010 Silverbrook et al. ..... 271/10.01
7,905,479 B2 3/2011 Samoto
7,959,147 B2 * 6/2011 Izuchi et al. ..... 271/9.02
7,963,519 B2 * 6/2011 Bokelman et al. ..... 271/117
8,292,288 B2 * 10/2012 Morinaga ..... 271/10.13
2004/0070136 A1 * 4/2004 Chung ..... 271/117
2005/0073087 A1 * 4/2005 Kadowaki et al. ..... 271/118
2009/0250867 A1 10/2009 Samoto
2010/0096797 A1 * 4/2010 Chen et al. ..... 271/109
2011/0156338 A1 * 6/2011 Samoto et al. ..... 271/4.08

FOREIGN PATENT DOCUMENTS

JP 2009-249134 A 10/2009

* cited by examiner

*Primary Examiner* — Jeremy R Severson
(74) *Attorney, Agent, or Firm* — Banner & Witcoff, Ltd.

(57) ABSTRACT

An image forming device includes: a feeding roller; a support shaft; a support portion; a drive shaft; a planetary gear unit; and a driving force transmission unit. The support portion rotatably supports the feeding roller and is pivotally movably supported to the support shaft. The drive shaft is rotatable upon receipt of a driving force from a motor. The planetary gear unit includes a sun gear rotatable integrally with the drive shaft, and a planetary gear swingably movable about the sun gear while maintaining meshing engagement therewith. The transmission unit includes an input gear meshingly engageable with the planetary gear when the drive shaft rotates. The transmission unit transmits the driving force to the feeding roller through the drive shaft, the sun gear, the planetary gear, and the input gear.

15 Claims, 8 Drawing Sheets

IMAGE FORMING DEVICE CAPABLE OF STABLY FEEDING RECORDING SHEET

CROSS REFERENCE TO RELATED APPLICATION

This application claims priority from Japanese Patent Application No. 2011-265003 filed Dec. 2, 2011. The entire content of the priority application is incorporated herein by reference.

TECHNICAL FIELD

The present invention relates to an image forming device provided with an image forming unit for forming an image on a recording sheet. More specifically, the present invention relates to an image forming device configured to feed recording sheets stacked on a stacked surface of a sheet supply tray toward the image forming unit by means of a feeding roller supported to one end portion of a pivotally movable support portion.

BACKGROUND

Conventionally, for example, it has been proposed that an image forming device, such as an ink-jet printer, feeds recording sheets, such as recording paper sheets, stacked on a stacked surface of a sheet supply tray toward an image forming unit by means of a feeding roller supported to one end portion of a pivotally movable support portion. In this case, it has also been proposed that the support portion has another end portion supported to and pivotally movable about a drive shaft to which a driving force is transmitted from a motor, and the driving force transmitted to the drive shaft is transmitted to the feeding roller through a gear mechanism described below. That is, a planetary gear mechanism including a sun gear and a planetary gear is provided for transmitting the drive force to the feeding roller. The sun gear is adapted to rotate integrally with the drive shaft. The planetary gear is adapted to be swingably moved about the sun gear while maintaining engagement with the sun gear. Upon swinging movement of the planetary gear in one direction, the planetary gear comes into engagement with a gear train coupling with the feeding roller. In this case, the planetary gear is engaged with the gear train only when the drive shaft rotates in one direction. Even when the drive shaft rotates both in forward and reverse directions, the above configuration can prevent the feeding roller from rotating in a direction opposite to a feeding direction.

SUMMARY

However, in case the gear train is provided at the support portion such as a swing arm, and the sun gear provided at the drive shaft about which the support portion is pivotally moved is rotated to provide engagement of a planetary gear with the gear train, a complex force is applied to a route for transmitting the driving force to the feeding roller. That is, in this case, when the planetary gear is engaged with the gear train, a self-weight of the support portion, and a reaction force applied to the support portion from a recording sheet exert an influence on the driving force transmission route, and hence, a transmission state of the driving force to the feeding roller becomes unstable. As a result, oblique (skew) feeding of the recording sheets by the feeding roller may occur.

In view of the foregoing, it is an object of the present invention to provide an image forming device configured to transmit a driving force to a feeding roller supported to one end portion of a pivotally movable support portion through a planetary gear mechanism and to feed a recording sheet placed on a sheet supply tray, the image forming device being capable of stably feeding the recording sheet.

In order to attain the above and other objects, the present invention provides an image forming device including: a tray; an image forming unit; a motor; a feeding roller; a support shaft; a support portion; a drive shaft; a main support portion; a planetary gear unit; and a driving force transmission unit. The tray has a surface on which a recording sheet is placed. The image forming unit is configured to form an image on the recording sheet. The motor is configured to generate a driving force. The feeding roller is configured to rotate upon receipt of the driving force to feed the recording sheet placed on the surface toward the image forming unit. The support shaft is disposed above the tray. The support portion has a first end portion and a second end portion. The support portion is configured to rotatably support the feeding roller at the first end portion, to be supported to the support shaft at the second end portion, and to be pivotally movable about the support shaft. The drive shaft is independent of the support shaft and configured to rotate upon receipt of the driving force from the motor. The main support portion is configured to rotatably support the drive shaft. The planetary gear unit includes a sun gear and a planetary gear. The sun gear is configured to rotate integrally with the drive shaft. The planetary gear is configured to be meshingly engaged with the sun gear and swingably moved about the sun gear while maintaining meshing engagement with the sun gear. The driving force transmission unit is provided at the support portion and includes an input gear. The input gear is configured to be meshingly engaged with the planetary gear when the planetary gear is swingingly moved in accordance with a rotational movement of the drive shaft. The driving force transmission unit is configured to transmit to the feeding roller the driving force that is transmitted from the drive shaft to the input gear through the sun gear and the planetary gear.

According to another aspect, the present invention provides a feeding device including: a tray; a feeding roller; a support portion; a support shaft; a motor; a driving force transmission unit; a planetary gear unit; and a main support portion. The tray in which a recording sheet is placed. The feeding roller is configured to feed the recording sheet placed in the tray. The support portion is configured to rotatably support the feeding roller. The support shaft is configured to pivotally movably support the support portion. The motor is configured to generate a driving force. The driving force transmission unit is provided at the support portion and configured to transmit the driving force to the feeding roller. The planetary gear unit includes a sun gear and a planetary gear. The sun gear is configured to rotate in a first rotation direction and in a second rotation direction opposite to the first rotation direction upon receipt of the driving force from the motor. The planetary gear is configured to partially orbitally move around the sun gear. The planetary gear is configured to transmit the driving force to the driving force transmission unit when the sun gear rotates in the first rotation direction and to interrupt transmission of the driving force to the driving force transmission unit when the sun gear rotates in the second rotation direction. The main support portion is independent of the support portion and configured to support the planetary gear unit.

According to still another aspect, the present invention provides a feeding device including: a main casing; a tray; a feeding roller; a support portion; a support shaft; a driving force transmission unit; a drive shaft; and a planetary gear unit. The tray is configured to be moved relative to the main casing and to accommodate a recording sheet therein. The feeding roller is configured to feed the recording sheet accommodated in the tray. The support portion is configured to rotatably support the feeding roller. The support shaft is configured to pivotally movably support the support portion. The driving force transmission unit is provided at the support portion and configured to transmit a driving force to the feeding roller. The drive shaft is provided at the main casing and configured to rotate in a first rotation direction and in a second rotation direction opposite to the first rotation direction. The planetary gear unit includes a sun gear and a planetary gear. The sun gear is provided at the main casing and configured to rotate integrally with the drive shaft. The planetary gear is configured to be meshingly engaged with the sun gear and to partially orbitally move around the sun gear while maintaining meshing engagement with the sun gear. The planetary gear is configured to transmit the driving force to the driving force transmission unit when the drive shaft rotates in the first rotation direction and to interrupt transmission of the driving force to the driving force transmission unit when the drive shaft rotates in the second rotation direction. The support portion, the feeding roller and the driving force transmission unit are pivotally movable about the support shaft in accordance with a movement of the tray relative to the main casing.

DETAILED DESCRIPTION

Figure 1:
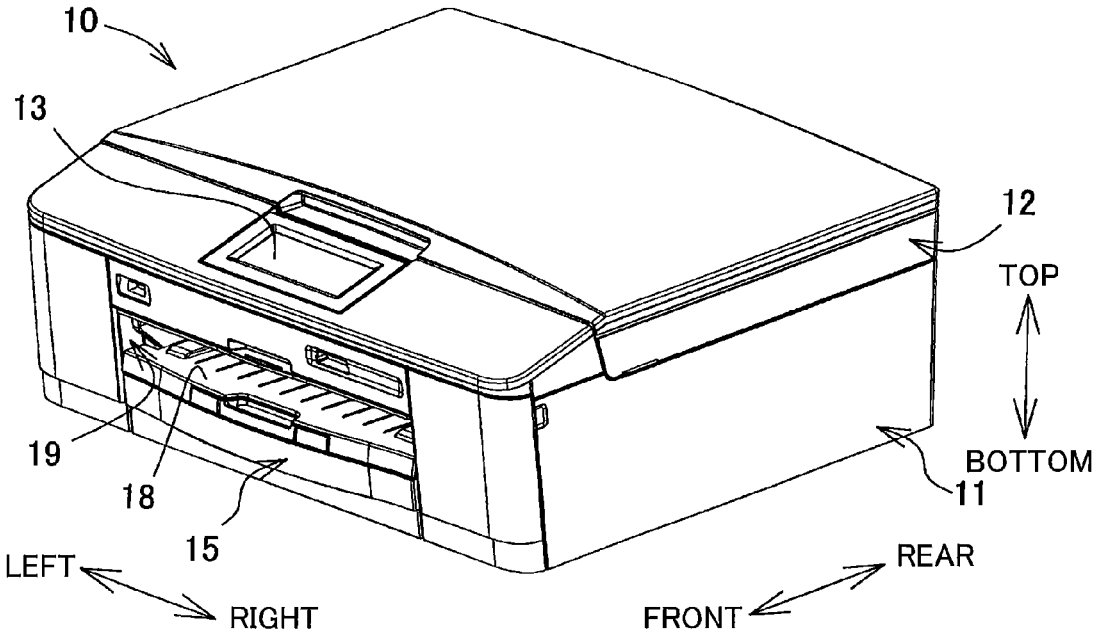
FIG. 1 is a perspective view of an outer appearance of an image forming device according to one embodiment of the present invention.

An image forming device (feeding device) according to one embodiment of the present invention will be described with reference to FIGS. 1 through 8. Throughout the specification, the terms "upward", "downward", "upper", "lower", "above", "below", "beneath", "right", "left", "front", "rear" and the like will be used assuming that the image forming device 1 is disposed in an orientation in which it is intended to be used. More specifically, in FIG. 1, an upper side will be referred to as an upper side, a side where a display unit 13 (described later) is provided will be referred to as a front side, and a right side of the image forming device as viewed from the front side will be referred to as a right side.

[Overall Structure of Image Forming Device]

The image forming device 10 according to the embodiment has a generally rectangular parallelepiped shape. The image forming device 10 has an upper portion at which a printer unit 11 is provided and a lower portion at which a scanner unit 12 is provided. The display unit 13 is provided at a front portion of the image forming device 10. The image forming device 10 is a multifunction device, including a printing function, a scanning function, and a copying function. The scanner unit 12 may be dispensed with. The image forming device 10 is further provided with a control unit (not shown). The printer unit 11 is controlled by the control unit.

The printer unit 11 is provided with a sheet supply tray 15, and a discharge tray 18 positioned above the sheet supply tray 15. The printer unit 11 is adapted to form an image on a recording sheet 50 (FIG. 2) placed on the sheet supply tray 15. The recording sheet 50 may be recording paper, glossy paper, a postcard, or letter paper. As shown in FIG. 1, the printer unit 11 is formed with an opening 19 at a front wall of the printer unit 11. The sheet supply tray 15 is accommodated in a lower portion of the printer unit 11, and can be pulled outward (frontward) from the printer unit 11 through the opening 19. More specifically, the sheet supply tray 15 is movable in the frontward/rearward direction between an accommodated position inside the printer unit 11 and a pulled-out position outside the printer unit 11. The sheet supply tray 15 has a flat rectangular parallelepiped shape having an open top.

Figure 2:
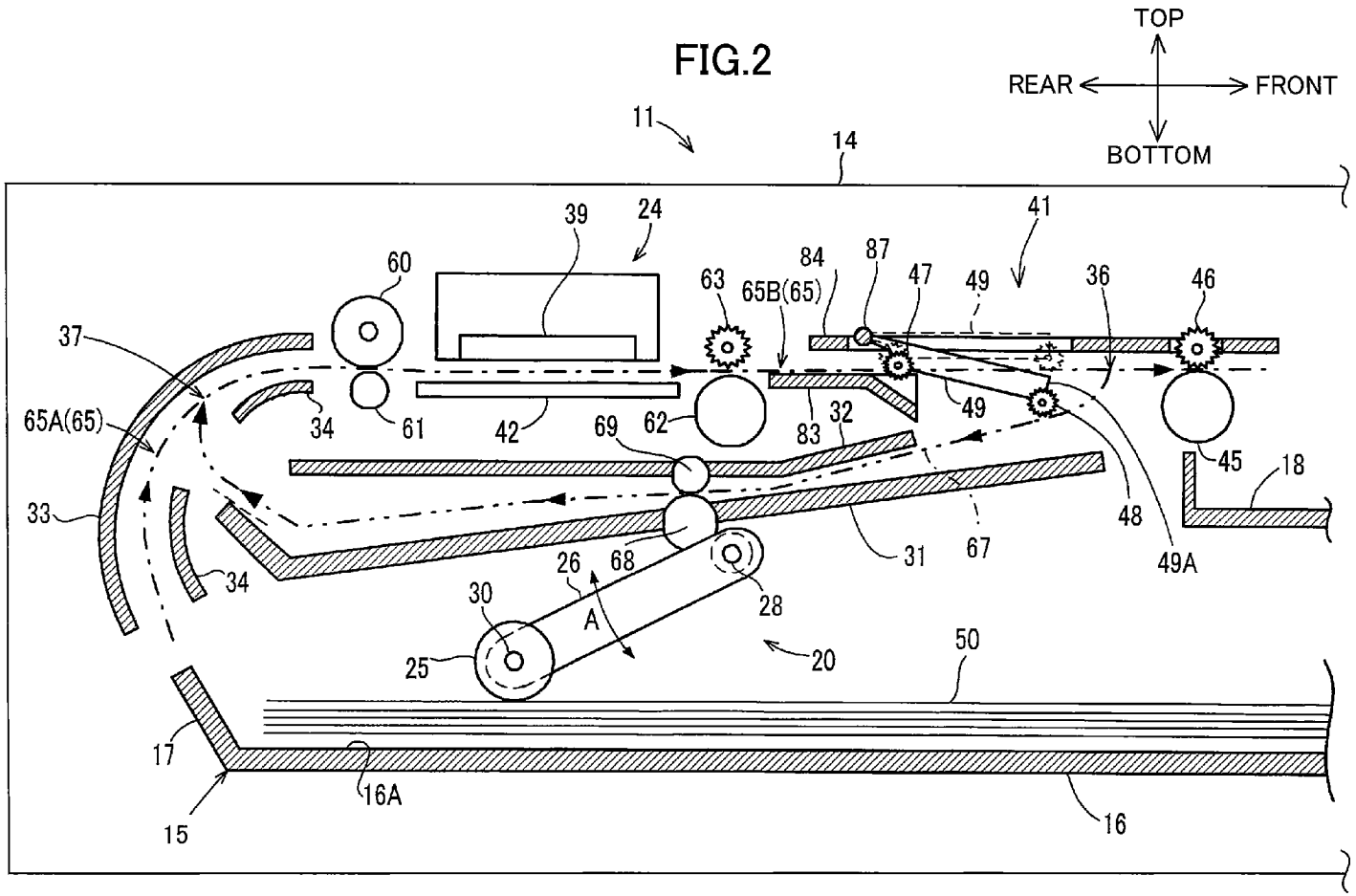
FIG. 2 is a cross-sectional view schematically illustrating a structure of an essential portion of the image forming device.

As shown in FIG. 2, the sheet supply tray 15 has a bottom portion 16 provided with an upper surface (hereinafter referred to as a stacked surface 16A) on which the recording sheets 50 are stacked. The sheet supply tray 15 has a rear wall 17 extending diagonally upward and rearward from a rear end portion of the bottom portion 16. The recording sheet 50 to be fed by a sheet feeding unit 20 (described later) is guided to the rear wall 17 to be directed to a position diagonally upward and rearward.

The printer unit 11 is provided with the sheet feeding unit 20, an ink-jet type recording unit 24, and a path switching unit 41 (described later), those positioned above the sheet supply tray 15. The sheet feeding unit 20 is adapted to feed the recording sheet 50 from the sheet supply tray 15 toward the recording unit 24. The recording unit 24 is adapted to eject ink droplets on the recording sheet 50 fed by the sheet feeding unit 20 to form an image on the recording sheet 50. Incidentally, not only the ink-jet type but also various recording types including an electro-photographic type are available for the recording unit 24.

As shown in FIG. 2, the sheet feeding unit 20 is positioned above the sheet supply tray 15 and below the recording unit 24. The sheet feeding unit 20 is provided with a sheet supply roller 25, a sheet supply arm 26, and a shaft 28. The shaft 28 has an axis extending in the rightward/leftward direction. The sheet supply roller 25 is rotatably supported to a leading end portion (rear end portion) of the sheet supply arm 26 and adapted to feed the recording sheets 50 stacked on the stacked surface 16A of the sheet supply tray 15 toward the recording unit 24. The sheet supply arm 26 is supported to the shaft 28 provided at a base end portion (front end portion) of the sheet supply arm 26 and pivotally movable about the shaft 28 in a direction indicated by an arrow A. With this configuration, the sheet supply roller 25 is movable so as to contact the stacked surface 16A and to be spaced away from the stacked surface 16A. Hence, the sheet supply arm 26 is pivotally moved according to the number of the recording sheets 50 stacked on the stacked surface 16A, so that the sheet supply roller 25 is normally in contact with an uppermost sheet of the recording sheets 50 stacked on the stacked surface 16A. A driving mechanism of the sheet supply roller 25 will be described later in detail.

Here, as shown in FIG. 2, within the printer unit 11, a conveying path 65 is formed. The conveying path 65 extends from a leading end portion (rear end portion) of the sheet supply tray 15 toward the discharge tray 18 via the recording unit 24. The conveying path 65 includes a curved path 65A and a discharge path 65B. The curved path 65A is defined from the rear end portion of the sheet supply tray 15 to a first conveying roller 60. The discharge path 65B is defined from the first conveying roller 60 to the discharge tray 18.

The sheet supply roller 25 separates the uppermost recording sheet 50 from the remaining recording sheets 50 stacked on the stacked surface 16A to supply the uppermost recording sheet 50 to the curved path 65A, while the uppermost recording sheet 50 is in contact with the sheet supply roller 25.

The curved path 65A is a curved passage extending from a position adjacent to an upper end portion of the rear wall 17 of the sheet supply tray 15 to a position adjacent to the recording unit 24. The curved path 65A has a generally arcuate shape with a center thereof positioned inside the printer unit 11. The recording sheet 50 fed by the sheet supply roller 25 from the sheet supply tray 15 is curved along the curved path 65A in a conveying direction (i.e. a direction indicated by a chain line in FIG. 2), and guided to a pinching position where the recording sheet 50 is pinched between the first conveying roller 60 and a pinch roller 61. The curved path 65A is further defined between an outer guide member 33 and an inner guide member 34. The outer guide member 33 and the inner guide member 34 are arranged in confrontation with each other at a predetermined interval therebetween in a generally frontward/rearward direction.

Incidentally, the outer guide member 33, the inner guide member 34, and each guide member 31, 32, 83, 84 (described later) extend in a direction perpendicular to a sheet surface of FIG. 2 (i.e. rightward/leftward direction).

The discharge path 65B is a linear passage extending from the pinching position where the recording sheet 50 is pinched between the first conveying roller 60 and the pinch roller 61 to the discharge tray 18. The recording sheet 50 is guided in the discharge path 65B in the conveying direction (i.e. the direction indicated by the chain line in FIG. 2).

The discharge path 65B is further defined between the recording unit 24 and a platen 42 at a position where the recording unit 24 is provided. The recording unit 24 and the platen 42 are arranged in confrontation with each other at a predetermined interval therebetween in a vertical direction. The discharge path 65B is still further defined between an upper guide member 84 and a lower guide member 83 at a position where the recording unit 24 is not provided. The upper guide member 84 and the lower guide member 83 are arranged in confrontation with each other at a predetermined interval therebetween in the vertical direction.

In the printer unit 11, a divergence position 36 is provided at a downstream side of the recording unit 24 and also at a downstream side of a second conveying roller 62 (described later) in the conveying direction. The recording sheet 50 conveyed in the discharge path 65B switchbacks (moves backward) at a position downstream of the divergence position 36 in the conveying direction to be conveyed toward a reverse conveying path 67 (described later) when images are formed on respective sides of the recording sheet 50.

The recording unit 24 is positioned above the sheet supply tray 15. The recording unit 24 has a recording head reciprocatingly movable in the rightward/leftward direction (i.e. the direction perpendicular to the sheet surface in FIG. 2). The platen 42 is positioned below the recording unit 24. The platen 42 is adapted to support the recording sheet 50 horizontally. The recording head of the recording unit 24 ejects ink supplied from an ink cartridge (not shown) as a form of ink droplets through nozzles 39 on the recording sheet 50 conveyed on the platen 42 during the reciprocating movement of the recording head in the rightward/leftward direction. As a result, an image is formed on the recording sheet 50.

The recording sheet 50 is conveyed to the platen 42 by the first conveying roller 60 and the pinch roller 61, where an image is formed by the recording unit 24. Then, the recording sheet 50 is further conveyed by the second conveying roller 62 and a spur roller 63. As shown in FIG. 2, a third conveying roller 45 and a spur roller 46 are provided at a downstream side of the second conveying roller 62 and the spur roller 63 in the conveying direction. Further, the third conveying roller 45 and the spur roller 46 are positioned downstream of the divergence position 36 in the conveying direction.

The third conveying roller 45 is driven to rotate in a forward rotation direction and a reverse rotation direction as described below.

For example, on the one hand, at the time of forming an image on one surface of the recording sheet 50, the third conveying roller 45 rotates in the forward rotation direction. As a result, the recording sheet 50 is pinched between the third conveying roller 45 and the spur roller 46 to be conveyed downstream in the conveying direction, and discharged to the discharge tray 18.

On the other hand, at the time of forming images on both surfaces of the recording sheet 50, when a rear end portion of the recording sheet 50 is pinched between the third conveying roller 45 and the spur roller 46, the third conveying roller 45 stops rotating in the forward rotation direction to start rotating in the reverse rotation direction. As a result, the recording sheet 50 is conveyed in a direction opposite to the conveying direction, that is, a direction opposite to the direction in which the recording sheet 50 is directed toward the third conveying roller 45 from the first conveying roller 60. Hence, the recording sheet 50 is conveyed toward the reverse conveying path 67 (described later) by the path switching unit 41.

[Structure of Path Switching Unit]

As shown in FIG. 2, the path switching unit 41 is positioned at the discharge path 65B between the second conveying roller 62 and the divergence position 36. The path switching unit 41 is provided with supplemental rollers 47, 48, a flap portion 49, and a shaft 87. The shaft 87 extends in the rightward/leftward direction and is supported to a frame of the printer unit 11. The flap portion 49 is supported to the shaft 87 and pivotally movable about the shaft 87. The flap portion 49 has a rear end portion supported to the shaft 87, and a front end portion 49A positioned closer to the discharge tray 18 than the rear end portion. The supplemental rollers 47, 48 are rotatably supported to the flap portion 49. The supplemental rollers 47, 48 are contactable with a recording surface of the recording sheet 50, and thus formed in a spur like shape similar to the shape of the spur rollers 63, 46.

The flap portion 49 is pivotally movable about the shaft 87 between a discharge position (indicated by a broken line in FIG. 2) and a reverse position (indicated by a solid line in FIG. 2). In the discharge position, the flap portion 49 is positioned above the lower guide member 83. In the reverse position, the front end portion 49A is advanced downward of the divergence position 36.

When the flap portion 49 is at the discharge position, the recording sheet 50 conveyed past the recording unit 24 is further conveyed downstream in the conveying direction. When the flap portion 49 is at the reverse position, the third conveying roller 45 is rotated in the reverse rotation direction, so that the recording sheet 50 whose rear end portion is pinched between the third conveying roller 45 and the spur roller 46 is moved backward and conveyed to the reverse conveying path 67.

The flap portion 49 is normally at the reverse position due to its self-weight. However, the flap portion 49 is lifted up by the recording sheet 50 conveyed in the discharge path 65B, so that the flap portion 49 is pivotally moved to the discharge position. Further, when the rear end portion of the recording sheet 50 is conveyed past the supplemental roller 47, the flap portion 49 is pivotally moved from the discharge position to the reverse position due to its self-weight. Incidentally, the flap portion 49 may be pivotally moved by a motor.

The reverse conveying path 67 diverges from the discharge path 65B at the divergence position 36. The reverse conveying path 67 is positioned below the recording unit 24 and above the sheet feeding unit 20. The reverse conveying path 67 joins the curved path 65A at a convergence position 37 positioned upstream of the recording unit 24 in the conveying direction.

After the rear end portion of the recording sheet 50 is conveyed past the supplemental roller 47 and the flap portion 49 is pivotally moved to the reverse position, the third conveying roller 45 is rotated in the reverse rotation direction. As a result, the recording sheet 50 is conveyed toward the convergence position 37 in the reverse conveying path 67, as indicated by a two-dot chain line in FIG. 2. Further, the reverse conveying path 67 is defined between a first guide member 31 and a second guide member 32 positioned above the first guide member 31.

A fourth conveying roller 68, a re-conveying drive shaft 68A (described later, FIGS. 7A, 7B), a gear 68B (described later, FIGS. 7A, 7B), and a follow roller 69 are provided at the reverse conveying path 67. That is, the reverse conveying path 67 and various components provided at the reverse conveying path 67, such as the fourth conveying roller 68, the re-conveying drive shaft 68A, the gear 68B, and the follow roller 69, constitute a re-conveying unit.

The fourth conveying roller 68 is positioned below the follow roller 69 and in confrontation with the follow roller 69 at the reverse conveying path 67. The fourth conveying roller 68 is adapted to convey the recording sheet 50 with one surface on which an image has been formed toward the recording unit 24 for forming an image on another surface of the recording sheet 50. More specifically, the recording sheet 50 which has been conveyed to the reverse conveying path 67 by the third conveying roller 45 is pinched between the fourth conveying roller 68 and the follow roller 69, and conveyed along the reverse conveying path 67 by the fourth conveying roller 68 toward the convergence position 37. Then, the recording sheet 50 is again conveyed to the discharge path 65B, passing through the convergence position 37. As a result, images can be formed on both surfaces of the recording sheet 50.

[Support Structure of Sheet Feeding Unit]

Figure 3:
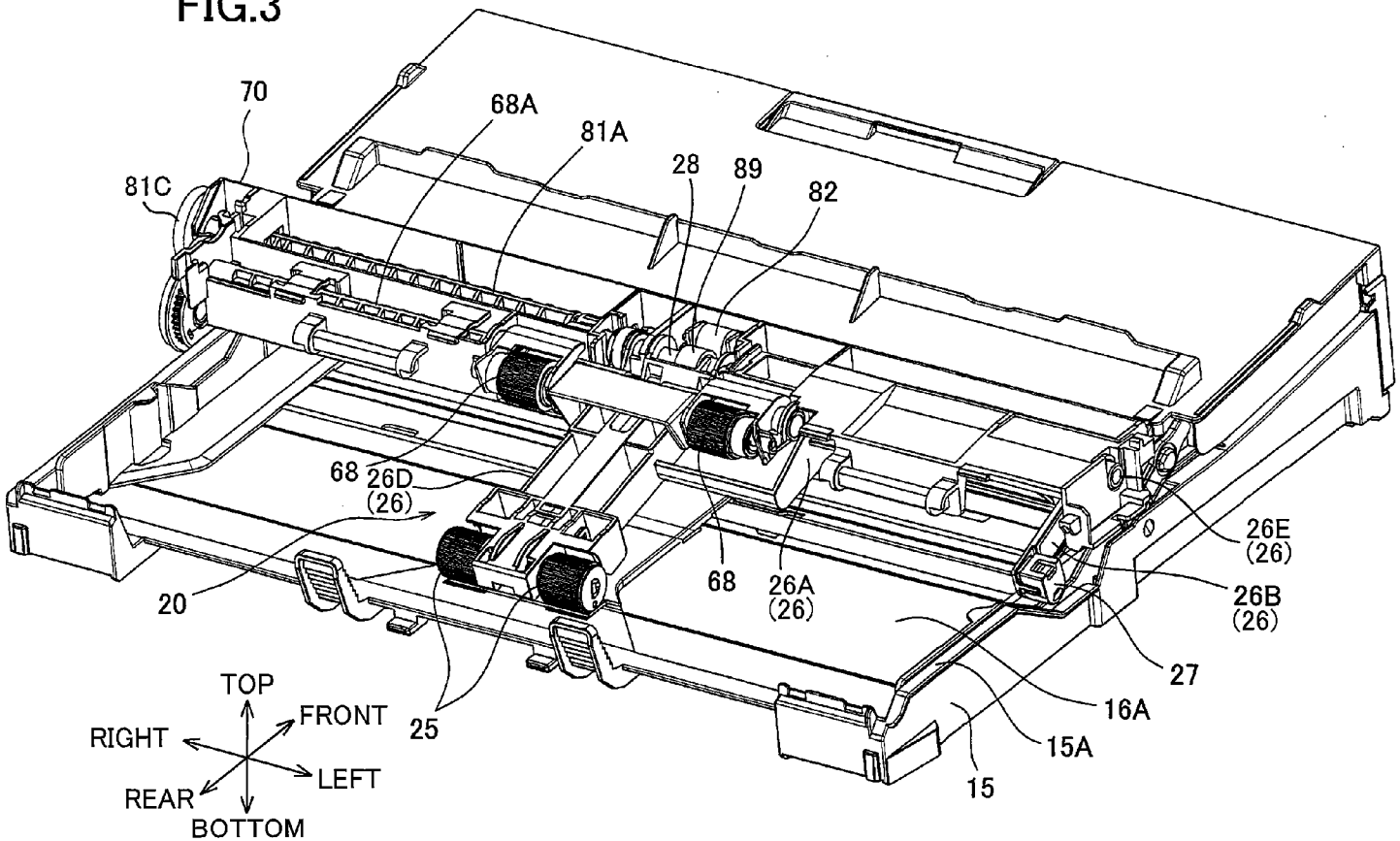
FIG. 3 is a perspective view of a part of the essential portion of FIG. 2 in a state where a sheet supply tray is at an accommodated position.

The image forming device 10 has a main frame 14 to which a main support portion 70 is assembled (fixed). Here, the main frame 14 implies a portion assembled to the image forming device 10 integrally with the platen 42, the first guide member 31, the second guide member 32, the lower guide member 83, the upper guide member 84, and the like. The main support portion 70 is formed of resin. As shown in FIG. 3, the sheet supply arm 26 is pivotally movably supported to the main support portion 70. The main support portion 70 is provided independently from the sheet supply arm 26. The main support portion 70 is generally rectangular shaped in a plan view and elongated in the rightward/leftward direction. The main support portion 70 has a length in the rightward/leftward direction substantially the same as a length in the rightward/leftward direction of the sheet supply tray 15. Incidentally, the main support portion 70 has an upper wall constituting a part of the first guide member 31. Further, the fourth conveying roller 68 including a pair of right end left roller segments is rotatably supported to the upper wall of the main support portion 70.

The sheet supply tray 15 has a left side wall at which a cam surface 15A is provided. The cam surface 15A has heights different at positions in a direction in which the sheet supply tray 15 is inserted into and pulled outward from the printer unit 11 (i.e. in the frontward/rearward direction).

Figure 4:
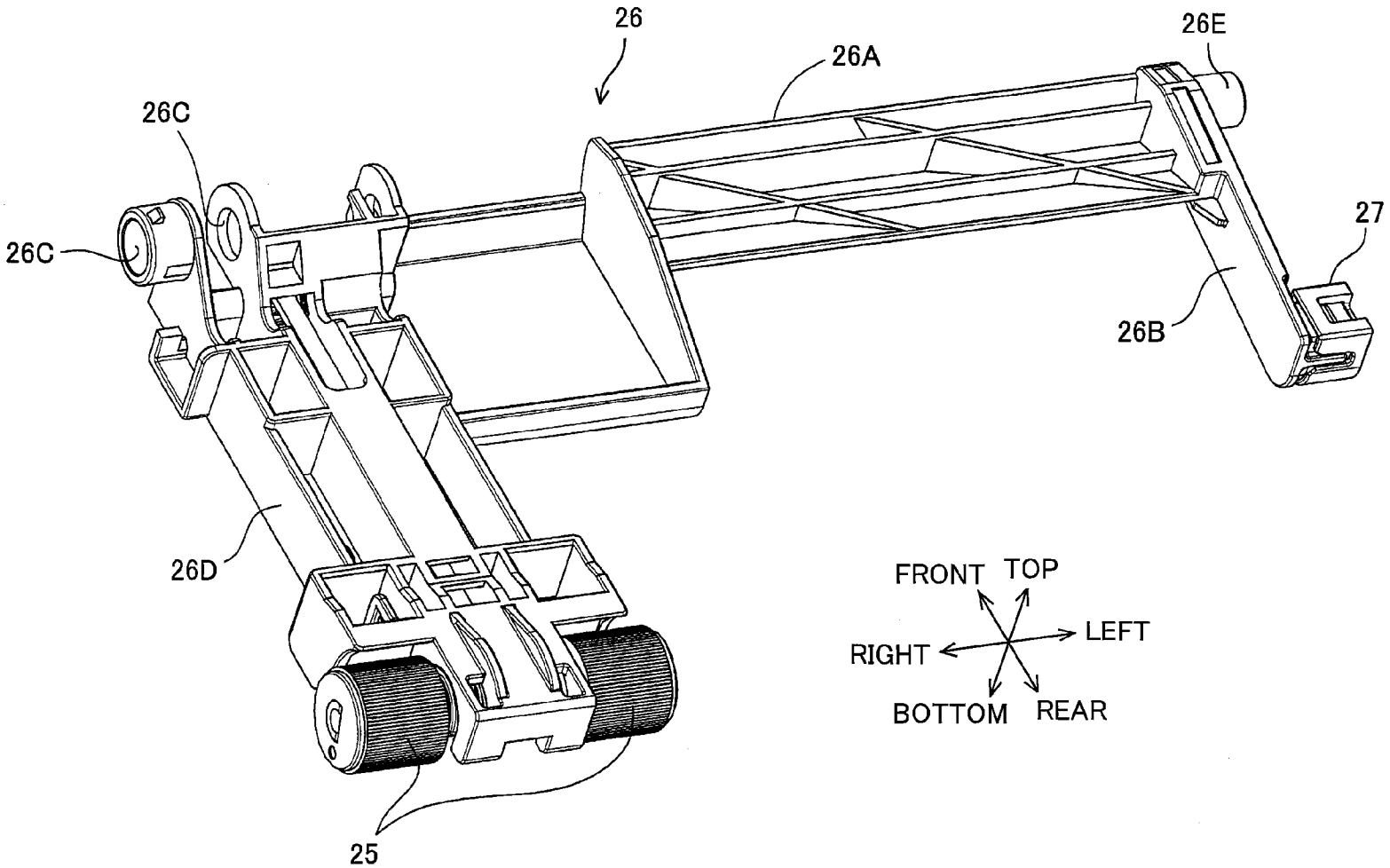
FIG. 4 is a perspective view illustrating a structure of a sheet supply arm in the part of the essential portion of FIG. 2.
Figure 5:
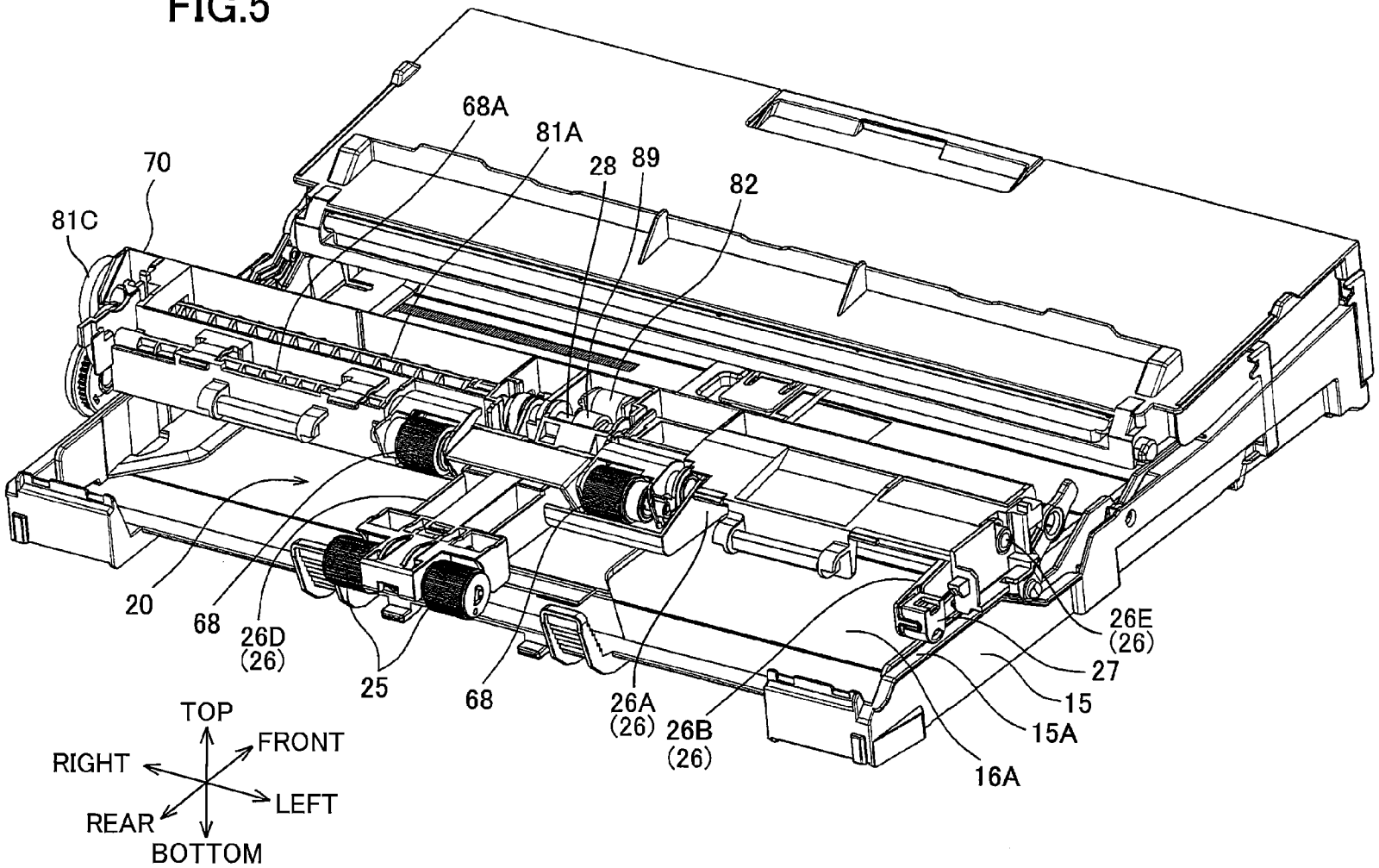
FIG. 5 is a perspective view of the part of the essential portion of FIG. 2 in a state where the sheet supply tray is pulled outward from a casing of the image forming device.
Figure 6:
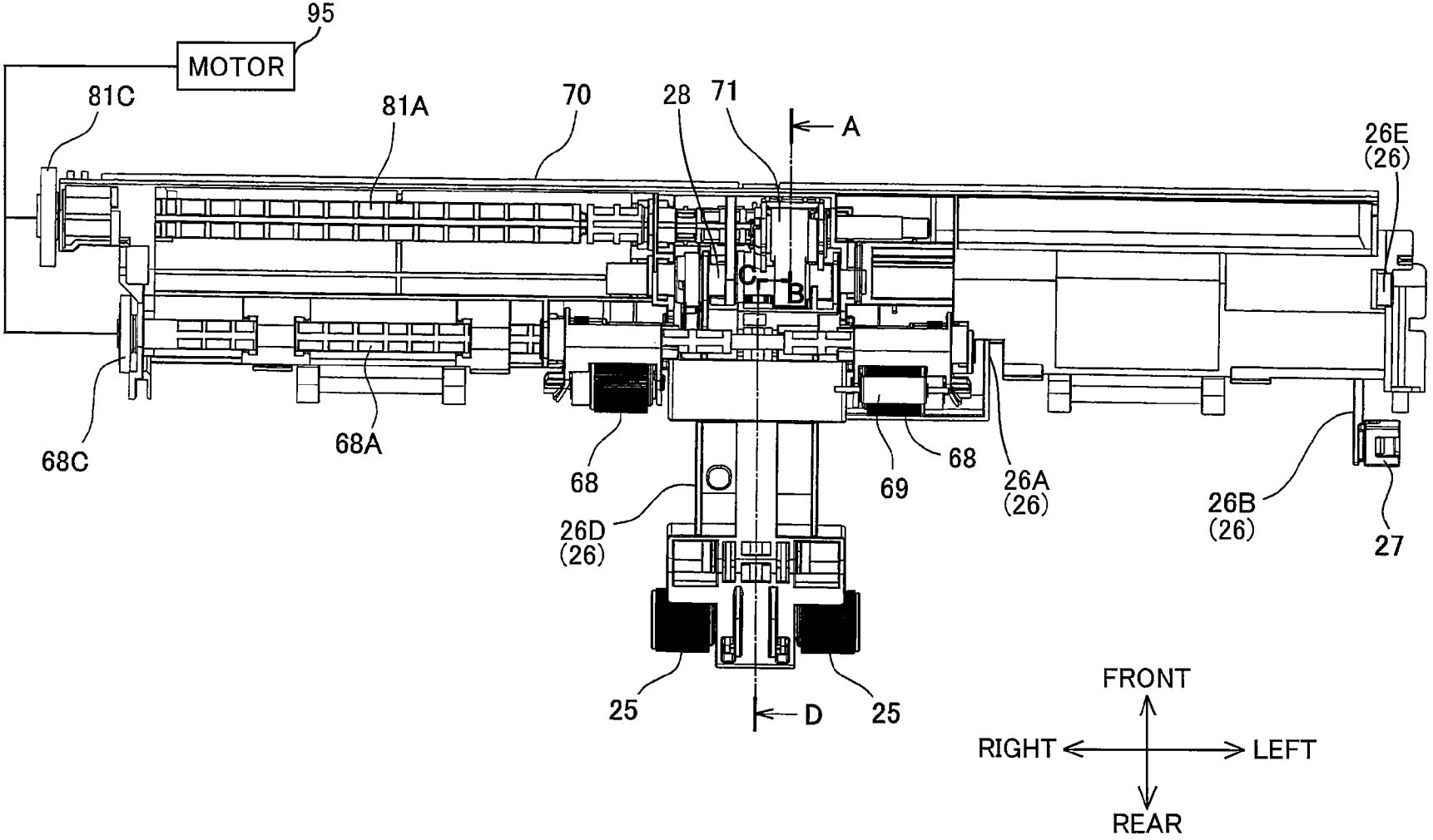
FIG. 6 is a plan view illustrating a structure of a main support portion in the part of the essential portion of FIG. 2, together with one of follow rollers shown in FIG. 2.

As shown in FIG. 4, the sheet supply arm 26 is provided with an arm portion 26D, an extending portion 26A, a lever portion 26B, and a protruding portion 26E. The arm portion 26D, the extending portion 26A, the lever portion 26B, and the protruding portion 26E are integral with each other and formed of resin.

The arm portion 26D extends in the frontward/rearward direction. The arm portion 26D has a rear end portion to which the sheet supply roller 25 including a pair of right and left roller segments is rotatably supported, and a front end portion formed with shaft holes 26C through which the shaft 28 extends. The shaft hole 26C serves as a center of pivotal movement of the sheet supply arm 26.

The extending portion 26A extends leftward from the front end portion of the arm portion 26D toward a left end portion of the sheet supply tray 15. The extending portion 26A has a left end portion from which the lever portion 26B extends parallel to the arm portion 26D (i.e. in the frontward/rearward direction).

The lever portion 26B is pivotally movable integrally with the arm portion 26D. The lever portion 26B has a rear end portion with which a cap 27 is fitted. The rear end portion of the lever portion 26B is abuttable on the cam surface 15A through the cap 27. The cap 27 is provided to facilitate smooth sliding movement of the lever portion 26B with the cam surface 15A.

The protruding portion 26E protrudes leftward from a front end portion of the lever portion 26B and is coaxial with the shaft hole 26C. The protruding portion 26E is rotatably supported to a U-shaped notch formed in a left side wall of the main support portion 70. The protruding portion 26E is positioned spaced apart from the shaft 28 in the rightward/leftward direction.

When the sheet supply tray 15 is at the accommodated position, the recording sheet 50 accommodated in the sheet supply tray 15 can be fed toward the recording unit 24 as described above while referring to FIG. 2. At this time, the cap 27 is not in contact with the cam surface 15A, as shown in FIG. 3. Hence, as described above, the sheet supply roller 25 is normally contactable with the uppermost recording sheet 50 stacked on the stacked surface 16A.

When the sheet supply tray 15 is pulled outward from the accommodated position, for example, to replenish the sheet supply tray 15 with the recording sheets 50, the cap 27 rides up over the cam surface 15A. As a result, the lever portion 26B is pivotally moved about the protruding portion 26E so that the rear end portion of the lever portion 26B is moved upward. In conjunction with pivotal movement of the lever portion 26B, the arm portion 26D is pivotally moved about the shaft 28 so that the rear end portion of the arm portion 26D is moved upward. Hence, the sheet supply roller 25 is spaced apart from the stacked surface 16A or the uppermost recording sheet 50 stacked on the stacked surface 16A. Accordingly, the sheet supply tray 15 can be easily pulled outward from the printer unit 11.

[Drive Mechanism of Sheet Feeding Unit]

As shown in FIG. 7, a planetary gear mechanism 80 (pendulum gear mechanism) and a drive shaft 81A (FIG. 6) are provided at the main support portion 70. The drive shaft 81A is rotatably supported to the main support portion 70. The planetary gear mechanism 80 includes a sun gear 81, a planetary gear 82, and a lever 85. The sun gear 81 is rotatable integrally with the drive shaft 81A. The lever 85 is pivotally movable about the drive shaft 81A. The planetary gear 82 is rotatably assembled to the lever 85 and meshingly engageable with the sun gear 81. Since the planetary gear 82 is rotatably assembled to the lever 85, the planetary gear 82 is swingably moved about the sun gear 81 while maintaining meshing engagement with the sun gear 81. In other words, the planetary gear 82 is partially orbitally movable around the sun gear 81, while maintaining meshingly engagement with the sun gear 81.

Further, the planetary gear mechanism 80 is covered by a cover 71 provided at an upper end face of the main support portion 70. Hence, the planetary gear mechanism 80 does not exert an influence on conveyance of the recording sheet 50.

A driving force transmission mechanism is provided at the sheet supply arm 26, more specifically, at the arm portion 26D. The driving force transmission mechanism is adapted to transmit a driving force to the sheet supply roller 25, and includes an input gear 89, a toothed timing pulley 91, a toothed timing pulley 92, and a toothed timing belt 93.

The input gear 89 is rotatably supported to the shaft 28 and rotatable about an axis of the shaft 28. That is, the input gear 89 is rotatably mounted on the shaft 28. The input gear 89 is provided at the front end portion of the arm portion 26D of the sheet supply arm 26. The input gear 89 is meshingly engageable with the planetary gear 82. Further, the input gear 89 is meshingly engaged with a gear (not shown) rotatable integrally with the toothed timing pulley 91. The toothed timing pulley 92 is rotatable integrally with the sheet supply roller 25, and positioned between the pair of right and left roller segments of the sheet supply roller 25. Incidentally, the toothed timing pulley 92 and the pair of right and left roller segments of the sheet supply roller 25 are coaxial with each other. The toothed timing belt 93 is stretched around the toothed timing pulley 91 and the toothed timing pulley 92. That is, the toothed timing belt 93 is stretched in a direction from the input gear 89 to the sheet supply roller 25.

Figure 7A:
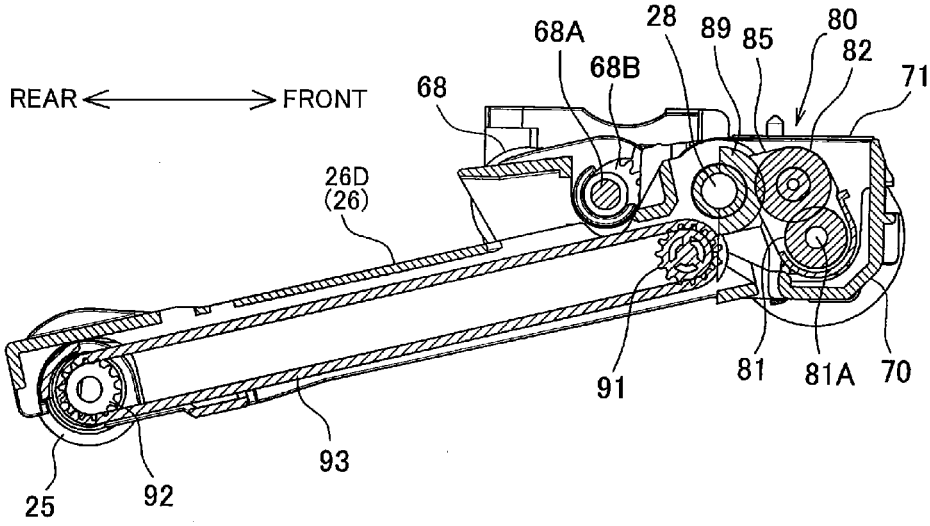
FIGS. 7A and 7B are each a cross-sectional view illustrating the structure and movement of the main support portion taken along a line A-B-C-D of FIG. 6.

When the sun gear 81 is rotated in a counterclockwise direction in FIG. 7A, the planetary gear 82 is swingingly moved about the sun gear 81 in a direction the same as a direction in which the sun gear 81 is rotated, that is, in the counterclockwise direction. As a result, as shown in FIG. 7A, the planetary gear 82 is moved toward the input gear 89 and brought into meshing engagement with the input gear 89. In association with counterclockwise rotation of the sun gear 81, the sheet supply roller 25 can be rotated in a clockwise direction in FIG. 7A, that is, in a feeding direction of the recording sheet 50, through the planetary gear 82, the input gear 89, the toothed timing pulley 91, the toothed timing belt 93, and the toothed timing pulley 92.

More specifically, when the drive shaft 81A is driven to rotate in the counterclockwise direction in FIG. 7A so as to rotate the sun gear 81 in the counterclockwise direction, the planetary gear 82 assembled to the lever 85 is swingingly moved about the sun gear 81 in the counterclockwise direction while rotating in the clockwise direction, so that the planetary gear 82 is moved toward the input gear 89 and brought into meshing engagement with the input gear 89, thereby transmitting a driving force from the drive shaft 81A to the input gear 89. The driving force transmitted to the input gear 89 is then transmitted to the sheet supply roller 25 through the toothed timing pulley 91, the toothed timing belt 93, and the toothed timing pulley 92. As a result, the sheet supply roller 25 is rotated in the feeding direction.

Figure 7B:
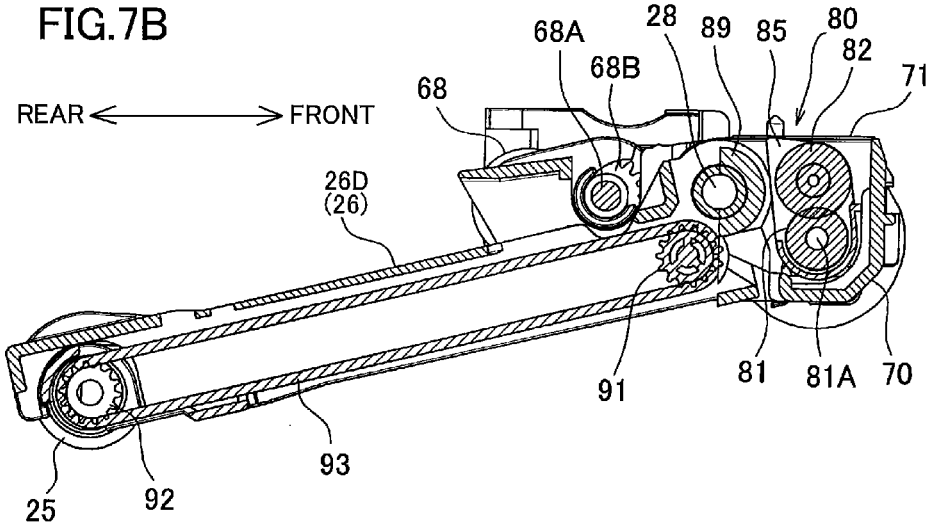

When the sun gear 81 is rotated in a clockwise direction in FIG. 7B, the planetary gear 82 is swingingly moved about the sun gear 81 in a direction the same as a direction in which the sun gear 81 is rotated, that is, in the clockwise direction. As a result, as shown in FIG. 7B, the planetary gear 82 is moved away from the input gear 89 to be disengaged from the input gear 89. Accordingly, rotation of the sheet supply roller 25 is stopped.

That is, when the drive shaft 81A is driven to rotate in the clockwise direction in FIG. 7B so as to rotate the sun gear 81 in the clockwise direction, the planetary gear 82 assembled to the lever 85 is swingingly moved about the sun gear 81 in the clockwise direction while rotating in the counterclockwise direction, so that the planetary gear 82 is moved away from the input gear 89 and disengaged from the input gear 89, thereby interrupting transmission of the driving force from the drive shaft 81A to the input gear 89. As a result, the driving force is not transmitted to the sheet supply roller 25, and thus, rotation of the sheet supply roller 25 is interrupted.

Further, as shown in FIGS. 7A and 7B, the main support portion 70 rotatably supports the re-conveying drive shaft 68A. The re-conveying drive shaft 68A is adapted to drive (rotate) the fourth conveying roller 68 through the gear 68B rotatable integrally with the re-conveying drive shaft 68A.

Figure 8:
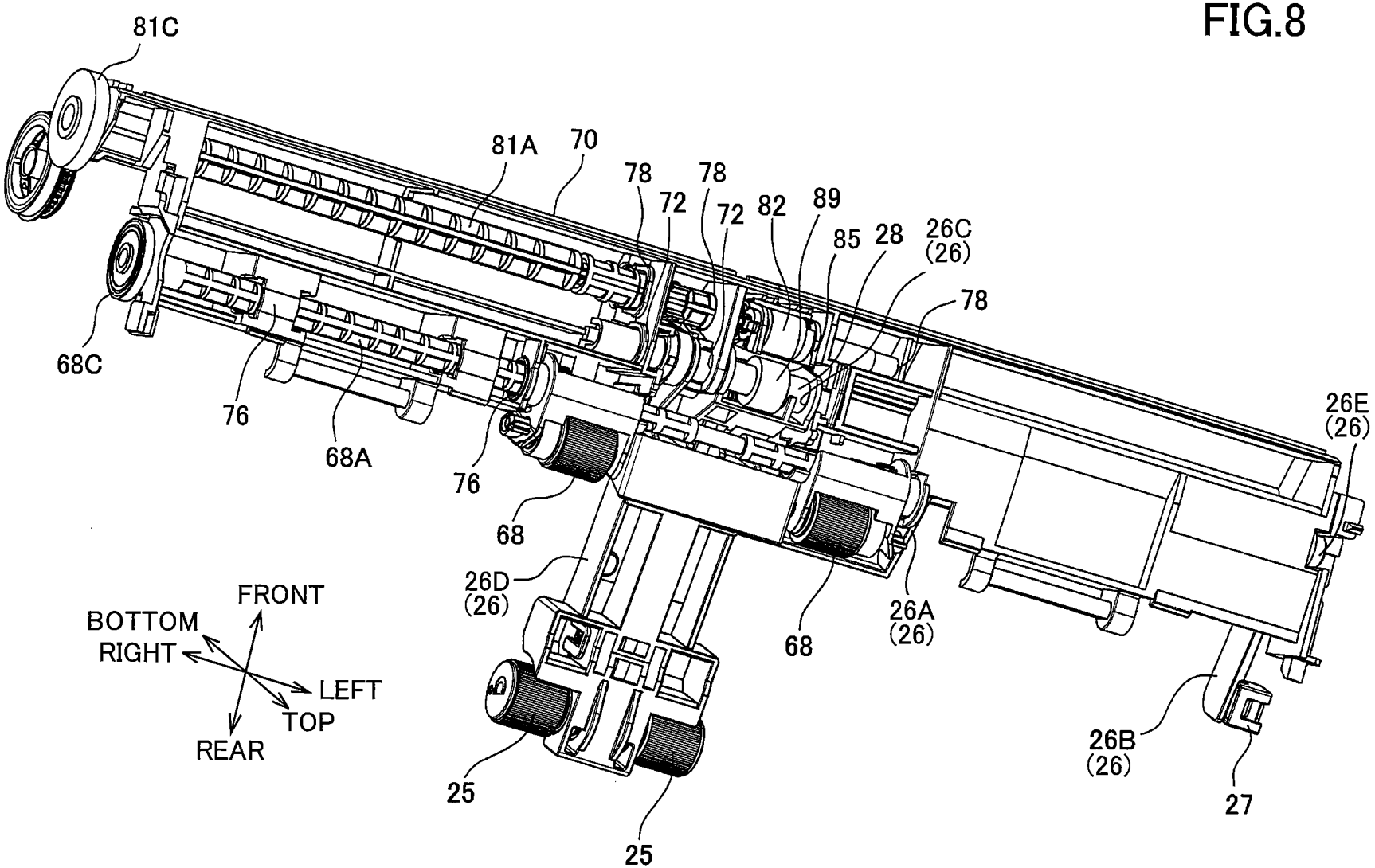
FIG. 8 is a perspective view illustrating the structure of the main support portion, but a cover thereof is omitted.

As shown in FIG. 8, the main support portion 70 is provided with a plurality of bearing portions 72, a plurality of bearing portions 76, and a plurality of bearing portions 78. Each bearing portion 72 serves to support the shaft 28, and the shaft 28 is rotatable relative to the bearing portion 72. Each bearing portion 76 serves to support the re-conveying drive shaft 68A, and the re-conveying drive shaft 68A is rotatable relative to the bearing portion 76. Each bearing portion 78 serves to support the drive shaft 81A, and the drive shaft 81A is rotatable relative to the bearing portion 78.

The arm portion 26D of the sheet supply arm 26 and the shaft 28 are positioned at a center portion of the main support portion 70 in the rightward/leftward direction (i.e. widthwise direction). The drive shaft 81A and the re-conveying drive shaft 68A extend rightward from the center portion of the main support portion 70 in the rightward/leftward direction and parallel to each other, and protrude rightward from a right side wall of the main support portion 70. The drive shaft 81A and the re-conveying drive shaft 68A extend parallel to the shaft 28 and are independent of the shaft 28.

The drive shaft 81A has a right end portion at which a gear 81C is provided. The re-conveying drive shaft 68A has a right end portion at which a gear 68C is provided. A motor 95 (FIG. 6) adapted to generate a driving force is provided in the printer unit 11. The driving force is transmitted from the motor to the gear 81C and the gear 68C to rotate the drive shaft 81A and the re-conveying drive shaft 68A, respectively, so that the sheet supply roller 25 and the fourth conveying roller 68 are rotated, as described above. More specifically, the motor 95 can rotate in a first direction and in a second direction opposite to the first direction. When the motor 95 rotates in the first direction, the drive shaft 81A and the sun gear 81 rotate in the counterclockwise direction. When the motor 95 rotates in the second direction, the drive shaft 81A and the sun gear 81 rotate in the clockwise direction.

The drive shaft 81A and the planetary gear mechanism 80 are positioned frontward of the shaft 28. In other words, the drive shaft 81A and the planetary gear mechanism 80 are positioned opposite to the sheet supply roller 25 with respect to the shaft 28. Further, the drive shaft 81A and the planetary gear mechanism 80 are positioned partly superposed with the shaft 28, the sheet supply arm 26, and the fourth conveying roller 68 along the stacked surface 16A in the frontward/rearward direction (FIGS. 7A, 7B).

Further, the sheet supply roller 25 and the planetary gear mechanism 80, the driving force transmission mechanism including the input gear 89, the toothed timing pulley 91, the toothed timing pulley 92 and the toothed timing belt 93 are aligned in the frontward/rearward direction. Further, a distance between an outer (right) end face (claimed first end face) of the right roller segment of the sheet supply roller 25 and an outer (left) end face (claimed third end face) of the left roller segment of the sheet supply roller 25 is greater than a length (claimed first length) in the axial direction of the driving force transmission mechanism, and also greater than a length (claimed second length) in the axial direction of the planetary gear mechanism 80.

[Operational Advantages and Modifications]

As described above, in the image forming device 10 according to the present embodiment, the planetary gear mechanism 80 and the drive shaft 81A are provided independently from the shaft 28 about which the sheet supply arm 26 is pivotally moved. Hence, this configuration can suppress unstable transmission of the driving force relative to the sheet supply roller 25, thereby preventing occurrence of skew feeding when the recording sheet 50 is fed by the sheet supply roller 25. As a result, the recording sheet 50 can be fed stably.

Further, according to the present embodiment, the sun gear 81 and the planetary gear 82 are provided not at the pivotally movable sheet supply arm 26 but at the main support portion 70 fixed to the main frame 14 of the image forming device 10. In case the sun gear 81 and the planetary gear 82 are provided in the sheet supply arm 26, a space is required for swinging movement of the planetary gear mechanism 80 in conjunction with pivotal movement of the sheet supply arm 26. Accordingly, the configuration according to the present embodiment can downsize the image forming device 10 in its entirety, compared to the latter configuration.

Further, the input gear 89 is rotatable about the shaft 28. A force applied to the input gear 89 when the planetary gear 82 is moved toward and away from the input gear 89 is unlikely to act in a direction to pivotally move the sheet supply arm 26. Hence, this configuration can avoid change in the contact state between the sheet supply roller 25 and the recording sheet 50 in accordance with the contacting and separating movement of the planetary gear 82 relative to the input gear 89.

Further, the shaft 28 and the drive shaft 81A are supported to the main support portion 70 through the bearing portions 72 and the bearing portions 78, respectively, and are arranged parallel to each other. Hence, the positional relationship between the shaft 28 and the drive shaft 81A can be reliably maintained. Thus, unstable transmission of the driving force relative to the sheet supply roller 25 can be suppressed more reliably. Accordingly, the recording sheet 50 can be fed more stably.

Further, in the image forming device 10 according to the present embodiment, the drive shaft 81A and the planetary gear mechanism 80 are positioned opposite to the sheet supply roller 25 with respect to the shaft 28. In other words, the drive shaft 81A and the planetary gear mechanism 80 are positioned frontward of the shaft 28. Further, the drive shaft 81A and the planetary gear mechanism 80 are provided at a position partially overlapping with the sheet supply arm 26 along the stacked surface 16A. Further, the drive shaft 81A and the planetary gear mechanism 80 are provided at a position partly overlapping with the fourth conveying roller 68 along the stacked surface 16A. Thus, the image forming device 10 can also be downsized in the vertical direction.

Further, in the image forming device 10 according to the present embodiment, the mechanism for pivotally moving the sheet supply arm 26, such as the lever portion 26B, is provided at a left side of the sheet supply arm 26 (the arm portion 26D), while the mechanism for rotating the sheet supply roller 25 and the fourth conveying roller 68, such as the drive shaft 81A and the re-conveying drive shaft 68A, is provided at a right side of the sheet supply arm 26 (the arm portion 26D). Thus, these two mechanisms are separately disposed at one and another sides in the widthwise direction, which leads to further downsizing of the image forming device 10.

In addition, the drive shaft 81A and the re-conveying drive shaft 68A both extend to a right side of the main support portion 70. Simplification of the driving system for driving the drive shaft 81A and the re-conveying drive shaft 68A leads to further downsizing of the image forming device 10.

Further, various modifications are conceivable.

For example, the driving force may be transmitted from the input gear 89 to the sheet supply roller 25 by gears only. However, according to the above-described embodiment, the driving force is transmitted from the input gear 89 to the sheet supply roller 25 through the toothed timing belt 93. In this case, a thickness of the arm portion 26D in a direction perpendicular to a direction from the input gear 89 to the sheet supply roller 25 can be made smaller than that in the former configuration. Hence, the image forming device 10 can be further reliably downsized. Further, the input gear 89 is not necessarily rotated about an axis of the shaft 28. The input gear 89 may be supported to a shaft other than the shaft 28.

While the present invention has been described in detail with reference to the embodiments thereof, it would be apparent to those skilled in the art that various changes and modifications may be made therein without departing from the spirit of the present invention.

What is claimed is:

1. An image forming device comprising:

a tray having a surface on which a recording sheet is placed;

an image forming unit configured to form an image on the recording sheet;

a motor configured to generate a driving force;

a feeding roller configured to rotate upon receipt of the driving force to feed the recording sheet placed on the surface toward the image forming unit;

a support shaft disposed above the tray;

a support portion having a first end portion and a second end portion, the support portion being configured to rotatably support the feeding roller at the first end portion, to be supported to the support shaft at the second end portion, and to be pivotally movable about the support shaft;

a drive shaft independent of the support shaft and configured to rotate upon receipt of the driving force from the motor;

a main support portion configured to rotatably support the drive shaft;

a planetary gear unit provided at the main support portion, the planetary gear unit comprising a sun gear and a planetary gear, the sun gear being configured to rotate integrally with the drive shaft, the planetary gear being configured to be meshingly engaged with the sun gear and swingably moved about the sun gear while maintaining meshing engagement with the sun gear; and a driving force transmission unit provided at the support portion and comprising an input gear, the input gear being configured to be meshingly engaged with the planetary gear when the planetary gear is swingingly moved in accordance with a rotational movement of the drive shaft, the driving force transmission unit being configured to transmit to the feeding roller the driving force that is transmitted from the drive shaft to the input gear through the sun gear and the planetary gear.

2. The image forming device as claimed in claim 1, wherein the input gear is configured to rotate about the support shaft.

3. The image forming device as claimed in claim 1, wherein the main support portion comprises a shaft bearing portion configured to support the support shaft, the support shaft extending parallel to the drive shaft.

4. The image forming device as claimed in claim 1, wherein the drive shaft and the planetary gear unit are positioned opposite to the feeding roller with respect to the support shaft, the drive shaft and the planetary gear unit being positioned partly superposed with the support portion along the surface.

5. The image forming device as claimed in claim 1, wherein the support portion comprises a first portion, a second portion, and an abutted portion;

wherein the tray is configured to be moved relative to the main support portion in a moving direction, the tray having an abutment portion configured to abut on the abutted portion at the time of a movement of the tray in the moving direction, the abutment portion having different heights in the moving direction;

wherein the feeding roller and at least the first portion are positioned at a center portion of the surface in a widthwise direction perpendicular to the moving direction with respect to the surface;

wherein the widthwise direction includes a first widthwise direction and a second widthwise direction opposite to the first widthwise direction, the second portion extending in the first widthwise direction from the first portion and having a third end portion at a downstream side thereof in the first widthwise direction, the abutted portion being positioned at the third end portion;

wherein an abutment of the abutment portion on the abutted portion in association with the movement of the tray in the moving direction causes a pivotal movement of the support portion; and wherein the drive shaft extends in the second widthwise direction from the support portion.

6. The image forming device as claimed in claim 5, further comprising a re-conveying unit positioned above the support portion, the re-conveying unit comprising a re-conveying roller configured to convey once again to the image forming unit a recording sheet on which an image has been formed in the image forming unit, wherein the drive shaft and the planetary gear unit are positioned partly superposed with at least a part of the re-conveying roller along the surface.

7. The image forming device as claimed in claim 6, wherein the re-conveying unit further comprises a re-conveying drive shaft configured to drive the re-conveying roller, the main support portion being configured to rotatably support the re-conveying roller and the re-conveying drive shaft, the re-conveying drive shaft extending in the second widthwise direction from the support portion and parallel to the drive shaft.

8. The image forming device as claimed in claim 1, wherein the driving force transmission unit further comprises a belt stretched in a direction from the input gear toward the feeding roller.

9. The image forming device as claimed in claim 1, wherein the support shaft has an axis extending in an axial direction; and wherein the support portion comprises a first portion, a second portion and a protruding portion, the first portion being formed with a shaft hole through which the support shaft extends, the second portion extending from the first portion in the axial direction, the protruding portion protruding from the second portion in the axial direction, the protruding portion being positioned spaced apart from the support shaft in the axial direction.

10. The image forming device as claimed in claim 1, wherein the driving force transmission unit further comprises a transmission gear configured to rotate integrally with the feeding roller, the feeding roller including a first roller segment and a second roller segment, the transmission gear being positioned between the first roller segment and the second roller segment.

11. The image forming device as claimed in claim 10, wherein the first roller segment has an axis extending in an axial direction;

wherein the driving force transmission unit, the planetary gear unit and the feeding roller are aligned in a direction perpendicular to the axial direction;

wherein the first roller segment has a first end face and a second end face, the first end face being farther away from the transmission gear than the second end face from the transmission gear in the axial direction;

wherein the second roller segment has an axis coaxial with the axis of the first roller segment and has a third end face and a fourth end face, the third end face being farther away from the transmission gear than the fourth end face from the transmission gear in the axial direction;

wherein the driving force transmission unit has a first length in the axial direction, a distance between the first end face and the third end face in the axial direction being greater than the first length; and wherein the planetary gear unit has a second length in the axial direction, a distance between the first end face and the third end face in the axial direction being greater than the second length.

12. A feeding device comprising:

a tray in which a recording sheet is placed;

a feeding roller configured to feed the recording sheet placed in the tray;

a support portion configured to rotatably support the feeding roller;

a support shaft configured to pivotally movably support the support portion;

a motor configured to generate a driving force;

a drive shaft independent of the support shaft and configured to rotate upon receipt of the driving force from the motor;

a driving force transmission unit provided at the support portion and configured to transmit the driving force to the feeding roller;

a planetary gear unit comprising a sun gear and a planetary gear, the sun gear being configured to rotate in a first rotation direction and in a second rotation direction opposite to the first rotation direction upon receipt of the driving force from the motor through the drive shaft, the planetary gear being configured to partially orbitally move around the sun gear, the planetary gear being configured to transmit the driving force to the driving force transmission unit when the sun gear rotates in the first rotation direction and to interrupt transmission of the driving force to the driving force transmission unit when the sun gear rotates in the second rotation direction; and a main support portion independent of the support portion and configured to support the planetary gear unit, the planetary gear unit being provided at the main support portion.

13. The feeding device as claimed in claim 12, wherein the driving force transmission unit comprises an input gear configured to be meshingly engaged with the planetary gear.

14. The feeding device as claimed in claim 13, wherein the input gear is rotatably mounted on the support shaft.

15. A feeding device comprising:

a main casing;

a tray configured to be moved relative to the main casing and to accommodate a recording sheet therein;

a feeding roller configured to feed the recording sheet accommodated in the tray;

a support portion configured to rotatably support the feeding roller;

a support shaft configured to pivotally movably support the support portion;

a driving force transmission unit provided at the support portion and configured to transmit a driving force to the feeding roller;

a drive shaft provided at the main casing and independent of the support shaft, the drive shaft being configured to rotate in a first rotation direction and in a second rotation direction opposite to the first rotation direction;

a planetary gear unit comprising a sun gear and a planetary gear, the sun gear being configured to rotate integrally with the drive shaft, the planetary gear being configured to be meshingly engaged with the sun gear and to partially orbitally move around the sun gear while maintaining meshing engagement with the sun gear, the planetary gear being configured to transmit the driving force to the driving force transmission unit when the drive shaft rotates in the first rotation direction and to interrupt transmission of the driving force to the driving force transmission unit when the drive shaft rotates in the second rotation direction; and a main support portion independent of the support portion, the planetary gear unit being provided at the main support portion, wherein the support portion, the feeding roller and the driving force transmission unit are pivotally movable about the support shaft in accordance with a movement of the tray relative to the main casing.

* * * * *